US012467360B2

(12) United States Patent
Chen et al.

(10) Patent No.: US 12,467,360 B2
(45) Date of Patent: Nov. 11, 2025

(54) DEVICE AND METHOD FOR ADJUSTING TUNNEL SUPPORT FORCE

(71) Applicant: Ningbo Langda Engineering Technology Co., Ltd., Zhejiang (CN)

(72) Inventors: Liping Chen, Zhejiang (CN); Guogang Ying, Zhejiang (CN); Hanhua Zhu, Zhejiang (CN); Jiayuan He, Zhejiang (CN); Dan Chen, Zhejiang (CN); Yapeng Xing, Zhejiang (CN)

( * ) Notice: Subject to any disclaimer, the term of this patent is extended or adjusted under 35 U.S.C. 154(b) by 195 days.

(21) Appl. No.: 17/766,177

(22) PCT Filed: May 8, 2021

(86) PCT No.: PCT/CN2021/092408
§ 371 (c)(1),
(2) Date: Apr. 1, 2022

(87) PCT Pub. No.: WO2022/142051
PCT Pub. Date: Jul. 7, 2022

(65) Prior Publication Data

US 2024/0052744 A1 Feb. 15, 2024

(30) Foreign Application Priority Data

Dec. 29, 2020 (CN) ..... 202011593500.2

(51) Int. Cl.
*E21D 11/10* (2006.01)
*E21D 11/14* (2006.01)

(52) U.S. Cl.
CPC ..... *E21D 11/14* (2013.01); *E21D 11/10* (2013.01)

(58) Field of Classification Search
CPC ..... E21D 11/10; E21D 11/105; E21D 11/14; E21D 11/28
See application file for complete search history.

(56) References Cited

U.S. PATENT DOCUMENTS 1,903,866 A * 4/1933 Lacaprara ..... E21D 9/0692 405/150.1
3,258,135 A * 6/1966 Bigge ..... B60P 3/41 405/150.1

(Continued)

*Primary Examiner* — Benjamin F Fiorello
(74) *Attorney, Agent, or Firm* — Che-Yang Chen; Law Office of Michael Chen

(57) ABSTRACT

A tunnel supporting force adjusting device, comprising a fixed component, a movable supporting component and a driving component, wherein the fixed component is connected with section steel; the movable supporting component is connected with the fixed component and used for connecting with a tunnel trunk, and the movable supporting component, the fixed component and the section steel are fixedly connected with the tunnel trunk by pouring; and the driving component is detachably connected with the fixed component and the movable supporting component respectively to adjust the supporting force of the movable supporting component on the tunnel trunk. The present invention also discloses a tunnel supporting force adjusting method, in which adjusting devices are arranged in different positions of the section steel of the arch section of a tunnel to achieve fixed-point adjustment of the force in each position so as to form optimum supporting force and supporting effect.

8 Claims, 6 Drawing Sheets

(56) References Cited

U.S. PATENT DOCUMENTS

| | | | | | |
|---|---|---|---|---|---|
| 3,677,602 | A * | 7/1972 | Tabor | E21D 9/04 | 299/31 |
| 3,970,200 | A * | 7/1976 | Goetjen | E21D 11/40 | 405/148 |
| 4,407,609 | A * | 10/1983 | Cerutti | E21D 11/102 | 249/11 |
| 4,618,298 | A * | 10/1986 | Takamiya | E21D 9/0607 | 405/138 |
| 5,382,114 | A * | 1/1995 | Trevisani | E21C 25/30 | 405/138 |
| 2021/0148231 | A1* | 5/2021 | Mancini | E21D 11/105 | |

* cited by examiner

DEVICE AND METHOD FOR ADJUSTING TUNNEL SUPPORT FORCE

TECHNICAL FIELD

The present invention relates to the technical field of tunnel construction, and particularly relates to a tunnel supporting force adjusting device and method.

BACKGROUND

During the process of tunnel construction, a steel frame formed of section steel or grating steel is arranged in preliminary supporting or secondary lining for supporting to enhance the supporting rigidity and increase the bearing capacity. The steel frame adopted in preliminary supporting is mostly made of H-shaped, I-shaped or U-shaped steel.

During the supporting process of the steel frame, the supporting force of the steel frame is not distributed unevenly due to the complexity and uncertainty of the surrounding rock of the tunnel. The existing supporting device cannot form an optimum supporting force in each position of the arch section, and often has a phenomenon of unsymmetrical pressure, which results in unsatisfactory supporting effect and easily leads to the instability of the supporting structure, causing great difficulties to the later construction or maintenance process.

In view of the above problem, it is urgent to design a device and method to solve the problem in the prior art that the optimum supporting force cannot be formed in each position of the arch section, resulting in unsatisfactory supporting effect and causing great difficulties to the later construction or maintenance process.

SUMMARY

In view of the above detects, the technical problem to be solved by the present invention is to provide a tunnel supporting force adjusting device and method so as to solve the problem in the prior art that the optimum supporting force cannot be formed in each position of the arch section, resulting in unsatisfactory supporting effect and causing great difficulties to the later construction or maintenance process.

The present invention provides a tunnel supporting force adjusting device, which is arranged on section steel at intervals, comprising:

A fixed component, connected with the section steel;

A movable supporting component, connected with the fixed component and used for connecting with a tunnel trunk, wherein the movable supporting component, the fixed component and the section steel are fixedly connected with the tunnel trunk by pouring;

A driving component, detachably connected with the fixed component and the movable supporting component (2) respectively to adjust the supporting force of the movable supporting component on the tunnel trunk.

Preferably, the fixed component comprises:

A limiting connecting piece, connected with the section steel;

Casing pipes, connected with the limiting connecting piece and slidably connected with the movable supporting component;

Limiting components, respectively connected with the casing pipes and the movable supporting component to fix the adjusted movable supporting component.

Preferably, the movable supporting component comprises:

Internal force transmission parts, slidably connected with the casing pipes;

A top plate, connected with the internal force transmission parts and used for connecting with the tunnel trunk and applying a supporting force on the tunnel trunk.

Preferably, the limiting connecting piece comprises:

An upper limiting part, connected with the upper surface of the section steel and connected with one end of each casing pipe;

A lower limiting part, connected with the lower surface of the section steel and connected with the casing pipes to limit the casing pipes.

Preferably, the driving component comprises:

A base, detachably connected with the other end of each casing pipe; A power unit, arranged on the base and connected with the internal force transmission parts to drive the internal force transmission parts to move.

Preferably, each internal force transmission part has a hollow tubular structure, and a plurality of positioning holes are arranged in each internal force transmission part at intervals and used for mating with the limiting components.

Preferably, the number of the casing pipes is four, the casing pipes are symmetrically arranged on both sides of the section steel, and the internal force transmission parts are in one-to-one correspondence to the casing pipes.

Preferably, each casing pipe is provided with a long slot hole, and the internal force transmission parts are fixed by the limiting components through the long slot holes.

The present invention also provide a tunnel supporting force adjusting method, comprising the following specific steps:

Step 1: arranging a plurality of connecting assemblies on the I-steel at equal intervals;

Step 2: placing an assembling unit composed of the I-steel and the connecting assemblies behind the rock of a tunnel, adjusting the position of the I-steel to the top of the connecting assemblies to withstand the rock, and pouring the assembling unit to be connected and fixed with the rock of the tunnel, wherein a portion of the bottom of the connecting assemblies is reserved in the air during pouring;

Step 3: connecting a jack and a jack stand to the bottom of the connecting assemblies, wherein the jack provides a jacking force for the connecting assemblies;

Step 4: starting the jack to drive internal force transmission tubes of the connecting assemblies to move up and down in hollow casing pipes of the connecting assemblies, and adjusting the state of the connecting assemblies to adjust the magnitude of the supporting force on the tunnel;

Step 5: limiting and fixing the adjusted connecting assemblies;

Step 6: removing the jack and the jack stand, grouting the internal force transmission tubes and the hollow casing pipes, filling the gap between the connecting assemblies and the upper surface of I-steel after adjusting the supporting force, and grouting and filling the internal force transmission tubes and the hollow casing pipes.

It can be known from the above technical solution that the tunnel supporting force adjusting device provided by the present invention is a reliable and durable force transmission device, which is simple in structure, easy to machine and low in cost, has certain strength and can bear heavy loads. The fixed component transmits the reacting force in the process of adjusting the supporting force to the section steel while fixing the movable supporting component; the movable supporting component is closely connected with the tunnel trunk under the action of the jacking force of the driving component to provide a better supporting force for the tunnel trunk; and the magnitude of the supporting force can be precisely adjusted by adjusting the magnitude of the jacking force of the driving component. The present invention also provides a tunnel supporting force adjusting method, which solves the problem in the prior art that the optimum supporting force cannot be formed in each position of the arch section, resulting in unsatisfactory supporting effect and causing great difficulties to the later construction or maintenance process, has obvious effect and is suitable for extensive promotion.

DESCRIPTION OF DRAWINGS

To more clearly describe the technical solutions in the embodiments of the present invention or in the prior art, the drawings required to be used in the description of the embodiments or the prior art will be simply presented below. Obviously, the drawings in the following description are merely some embodiments of the present invention, and for those ordinary skilled in the art, other drawings can also be obtained according to the drawings without contributing creative labor.

Figure 1:
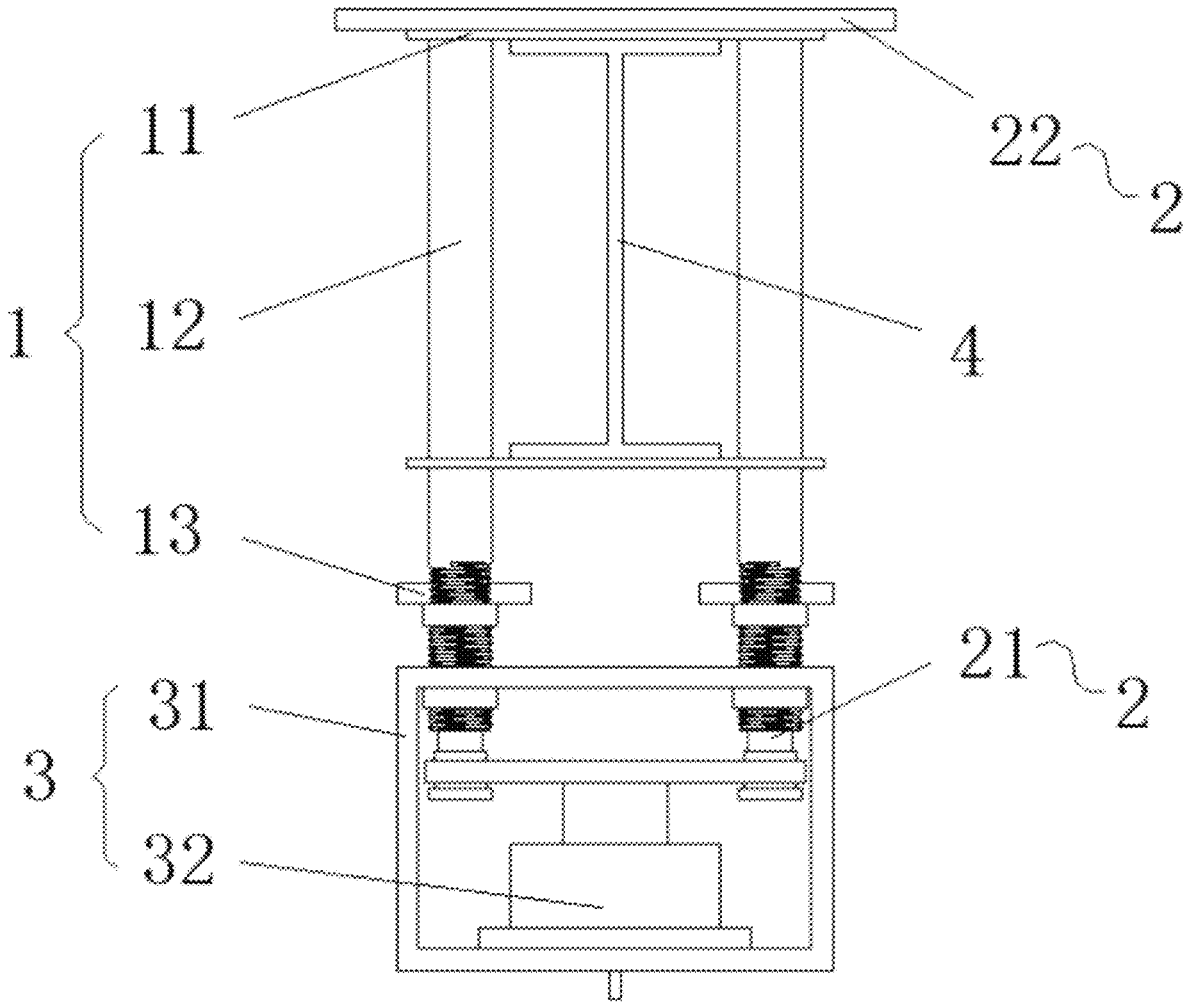
FIG. 1 is a structural schematic diagram of a tunnel supporting force adjusting device provided by embodiments of the present invention.
Figure 2:
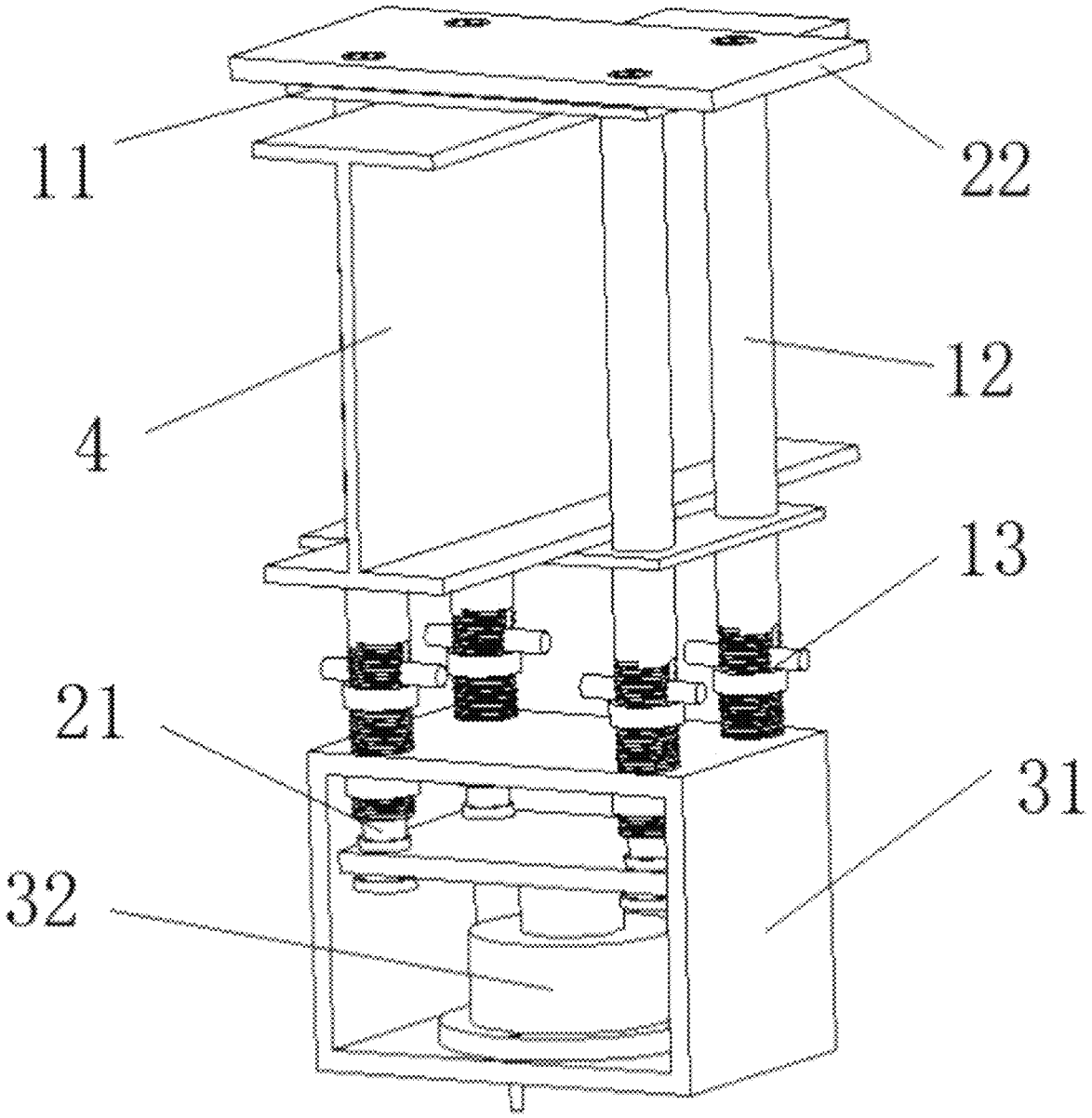
FIG. 2 is a three-dimensional structural schematic diagram of a tunnel supporting force adjusting device shown in FIG. 1.
Figure 3:
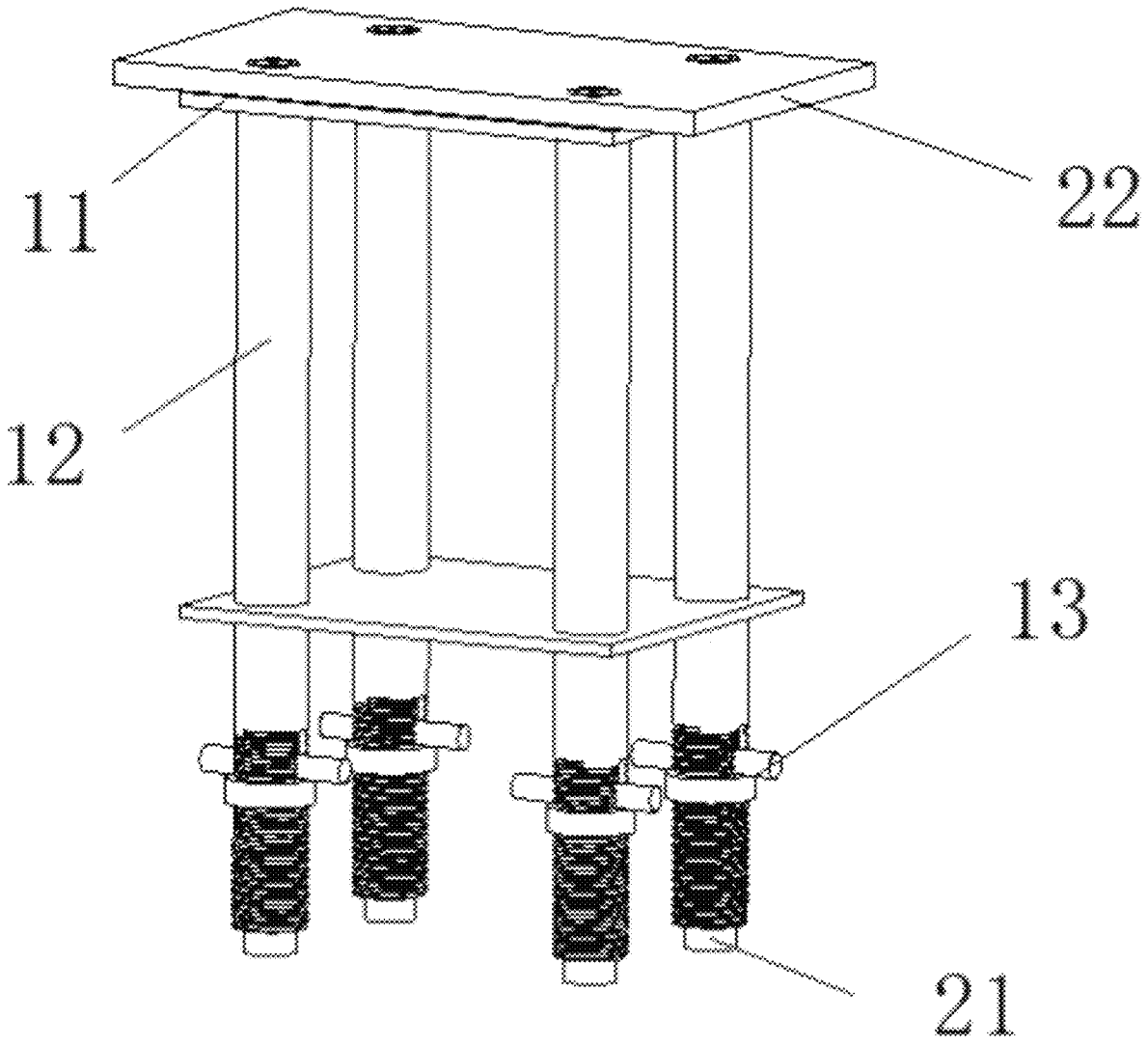
FIG. 3 is a structural schematic diagram of assembly of a fixed component and a movable supporting component of a tunnel supporting force adjusting device shown in FIG. 1.
Figure 4:
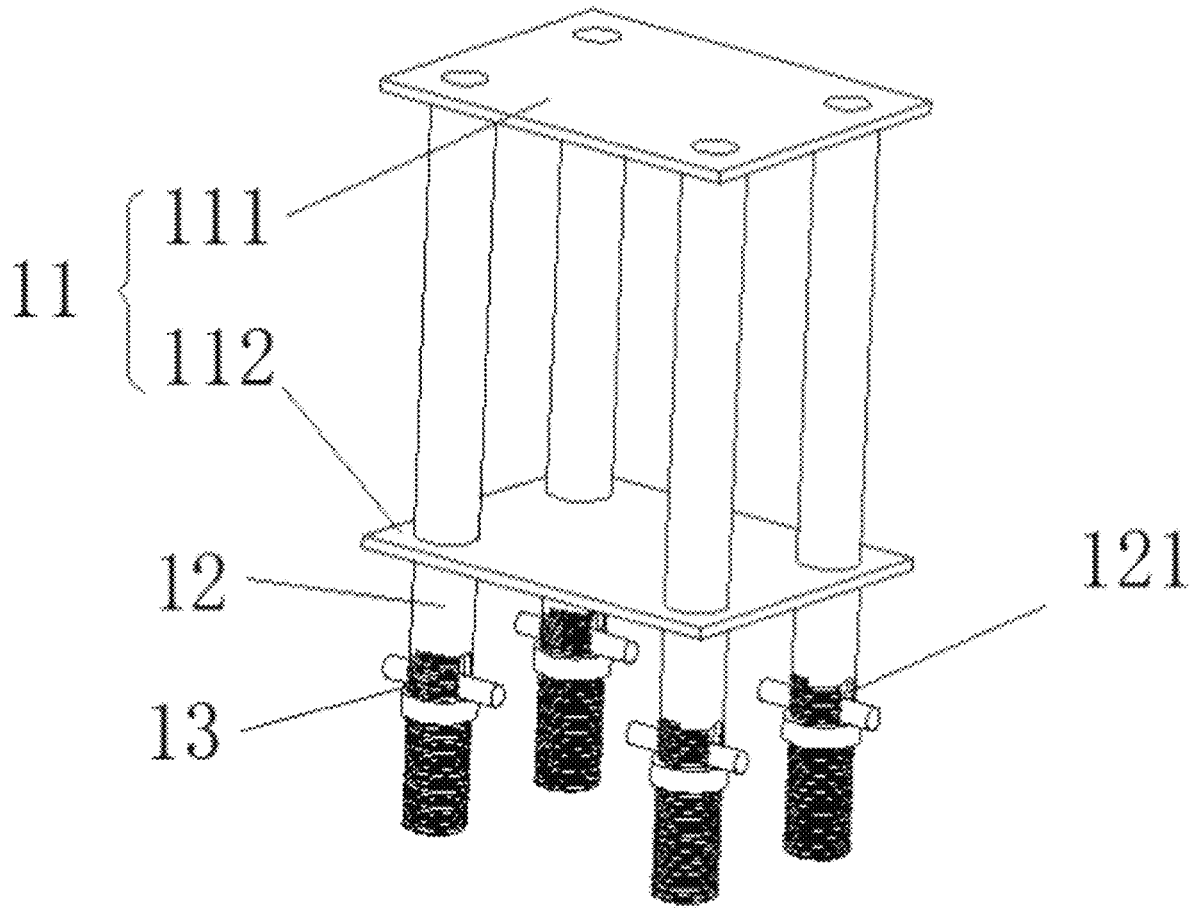
FIG. 4 is a structural schematic diagram of a fixed component shown in FIG. 3.
Figure 5:
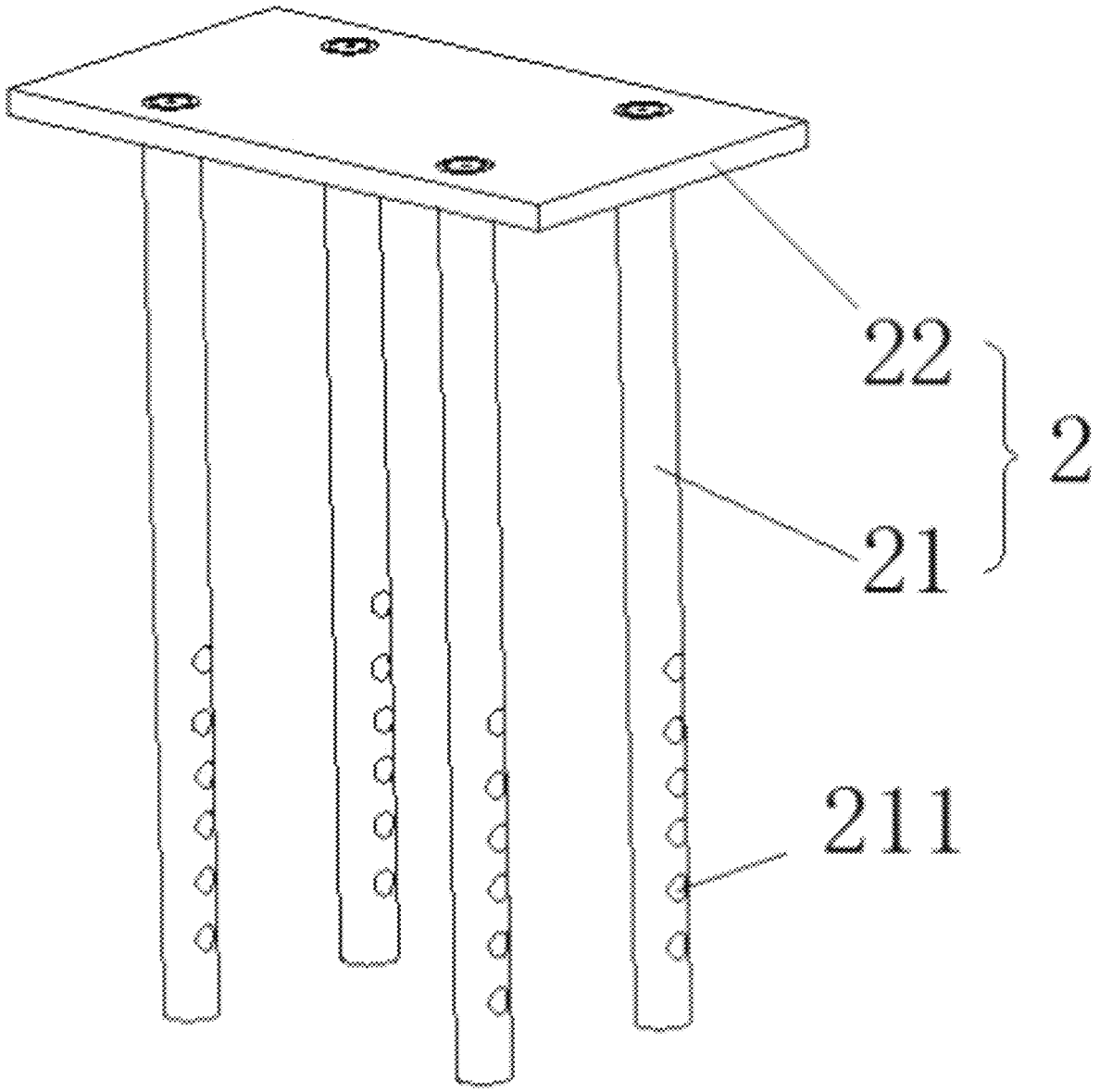
FIG. 5 is a structural schematic diagram of a movable supporting component shown in FIG. 3.
Figure 6:
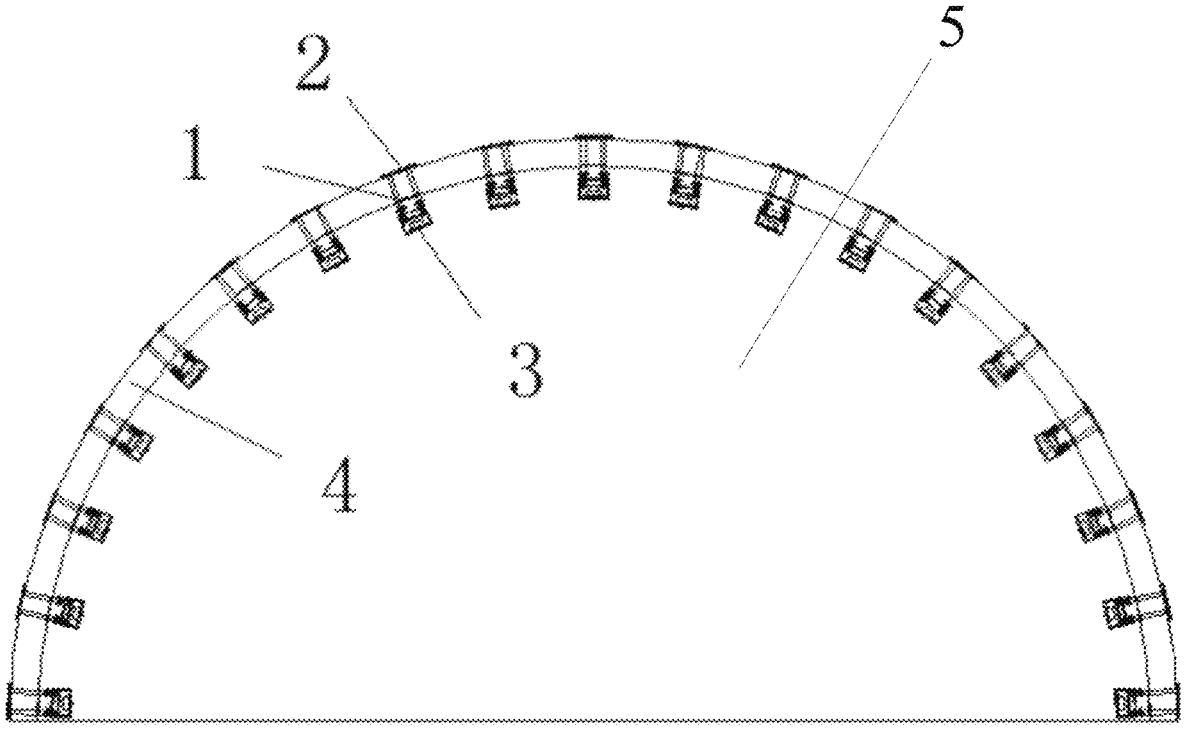
FIG. 6 is a structural schematic diagram of installation effect of a tunnel supporting force adjusting device provided by embodiments of the present invention on section steel of the arch section of a tunnel.

In the FIGS. 1-6:

1. fixed component; 2. movable supporting component; 3. driving component; 4. section steel; 11. limiting connecting piece; 12. casing pipe; 13. limiting component; 21. internal force transmission part; 22. top plate; 31. base; 32. power unit; 111. upper limiting part; 112. lower limiting part 121. long slot hole; and 211. positioning hole.

DETAILED DESCRIPTION

The technical solution in the embodiments of the present invention will be clearly and fully described below in combination with the drawings in the embodiments of the present invention. Apparently, the described embodiments are merely part of the embodiments of the present invention, not all of the embodiments. Based on the embodiments in the present invention, all other embodiments obtained by those ordinary skilled in the art without contributing creative labor will belong to the protection scope of the present invention.

Embodiment 1

With reference to FIG. 1 to FIG. 6, one specific embodiment of a tunnel supporting force adjusting device provided by the present invention is described. The tunnel supporting force adjusting device is arranged on the section steel 4 at intervals, exemplarily, which can be a device striding over the upper part of I20 I-steel and transferring loads to I-steel, comprising a fixed component 1, a movable supporting component 2 and a driving component 3, wherein the fixed component 1 is connected with the section steel 4; the movable supporting component 2 is connected with the fixed component 1 and used for connecting with a tunnel trunk 5, and the movable supporting component 2, the fixed component 1 and the section steel 4 are fixedly connected with the tunnel trunk 5 by pouring; the driving component 3 is detachably connected with the fixed component 1 and the movable supporting component 2 respectively to adjust the supporting force of the movable supporting component 2 on the tunnel trunk 5.

The fixed component 1 transmits the reacting force in the process of adjusting the supporting force to the section steel 4 while fixing the movable supporting component 2; the movable supporting component 2 is closely connected with the tunnel trunk 5 under the action of the jacking force of the driving component 3 to provide a better supporting force for the tunnel trunk 5; and the magnitude of the supporting force can be precisely adjusted by adjusting the magnitude of the jacking force of the driving component 3. Herein, all functions that can achieve the relevant performance of the fixed component 1, the movable supporting component 2 and the driving component 3 shall be included within the protection scope of the present application.

Compared with the prior art, the main material of the tunnel supporting force adjusting device can be ordinary machined steel, part of fittings can be adjusted to stainless steel or other materials according to the circumstances, and the supporting force adjusting device is simple in structure, easy to machine and low in cost. The tunnel supporting force adjusting devices are arranged in different positions of the section steel 4 of the arch section of the tunnel to achieve fixed-point adjustment of the force in each position so as to form optimum supporting force and supporting effect on the section. The present invention solves the problem in the prior art that the optimum supporting force cannot be formed in each position of the arch section, resulting in unsatisfactory supporting effect and causing great difficulties to the later construction or maintenance process, has obvious effect and is suitable for extensive promotion.

Embodiment 2

As a specific embodiment of the present invention, with reference to FIG. 1 to FIG. 6, the tunnel supporting force adjusting device provided by the embodiment has a structure basically the same as embodiment 1, and the difference is that the fixed component 1 comprises a limiting connecting piece 11, casing pipes 12 and limiting components 13, wherein the limiting connecting piece 11 is connected with the section steel 4; the casing pipes 12 are connected with the limiting connecting piece 11 and slidably connected with the movable supporting component 2; and the limiting components 13 are respectively connected with the casing pipes 12 and the movable supporting component 2 to fix the adjusted movable supporting component 2. The inner diameter of each casing pipe 12 is larger than the outer diameter of each internal force transmission part 21, which is favorable for the internal force transmission parts 21 to move up and down in the casing pipes 12 and leaves certain space for the grouting process.

In the embodiment, the limiting connecting piece 11 comprises an upper limiting part 111 and a lower limiting part 112, wherein the upper limiting part 111 is connected with the upper surface of the section steel 4 and connected with one end of each casing pipe 12, and exemplarily, the limiting connecting piece 11 can be a rectangular plate fitted to the surface of the section steel 4 and provided with a circular hole for the casing pipes 12 to pass through; and the lower limiting part 112 is connected with the lower surface of the section steel 4 and connected with the casing pipes 12 to limit the casing pipes 12. Each limiting component 13 can be a fixture or an anchor, and particularly can be an assembling unit of a limiting pin and a limiting nut which are used in combination to fix the internal force transmission part 21 at a later stage. An opening is formed at the joint of the limiting connecting piece 11 and the casing pipes 12, and the casing pipes 12 communicate with the outside through the opening for installation and grouting of the internal force transmission parts 21.

In the embodiment, the movable supporting component 2 comprises internal force transmission parts 21 and a top plate 22, wherein the internal force transmission parts are slidably connected with the casing pipes 12; and the top plate 22 is connected with the internal force transmission parts 21 and used for connecting with the tunnel trunk 5 and applying a supporting force on the tunnel trunk 5. Each internal force transmission part 21 has a hollow tubular structure which leaves enough flow space for subsequent grouting consolidation, an opening is formed at the joint of the top plate 22 and the internal force transmission parts 21 for the internal force transmission parts 21 to pass through, and slurry is injected and filled into the gap between the top plate 22 and the tunnel trunk 5 through the internal force transmission parts 21. Each internal force transmission part 21 is provided with a plurality of positioning holes 211 which are used for mating with the limiting components 13. The number of the casing pipes 12 is four, the casing pipes 12 are symmetrically arranged on both sides of the section steel 4, and the internal force transmission parts 21 are in one-to-one correspondence to the casing pipes 12. This arrangement has better stability and more uniform stress, and the top plate 22 has better supporting effect on the tunnel. Each casing pipe 12 is provided with a long slot hole 121, and the internal force transmission parts 21 are fixed by the limiting components 13 through the long slot holes 121. It should be noted that terms such as "upper", "lower", "top", "bottom", "inner", "outer", etc. indicate direction or position relationships shown based on the drawings, and are only intended to facilitate the description of the present invention and the simplification of the description rather than to indicate or imply that the fixed component 1, the movable supporting component 2 and the driving component 3 and component parts thereof must have a specific direction or constructed and operated in a specific direction, and therefore, shall not be understood as a limitation to the present invention.

In the embodiment, the driving component 3 comprises a base 31 and a power unit 32, wherein the base 31 is detachably connected with the other end of each casing pipe 12, exemplarily, the upper end surface of the base 31 can be provided with through holes, thread with a certain pitch is formed at the bottom of each casing pipe 12, the diameter of each through hole is larger than the outer diameter of each casing pipe 12, the base 31 is penetrated through the casing pipes 12 via the through holes, and the base 31 is fixed by connecting nuts with the casing pipes 12; and the power unit 32 is arranged on the base 31 and connected with the internal force transmission parts 21 to drive the internal force transmission parts 21 to move. The power unit 32 can be a jack provided with a bearing plate, the bearing plate is connected with the internal force transmission parts 21, and the arrangement of the bearing plate makes the stress on the internal force transmission parts 21 more uniform. During the process of applying pressure by the jack, the internal force transmission parts 21 can move up and down freely, and the limiting components 13 do not play a role temporarily. Only when the jack is removed, can the limiting components 13 lock to play a role.

Embodiment 3

With reference to FIG. 1 to FIG. 6, one specific embodiment of a tunnel supporting force adjusting method provided by the present invention is described, comprising the following specific steps:

S1: arranging a plurality of connecting assemblies respectively composed of the movable supporting component 2 and the fixed component 1 on the I-steel at equal intervals;

The specific steps of fixing each connecting assembly with the I-steel can be as follows:

S1.1: fixedly connecting the fixed component 1 and the I-steel, wherein the connecting mode can be welding, and installing the limiting nuts of the limiting components 13 on the casing pipes 12 of the fixed component 1;

The specific steps of fixedly connecting the fixed component 1 and the I-steel can be as follows: fixedly connecting the upper limiting part 111 and the lower limiting part 112 with the I-steel; and fixing the four hollow casing pipes 12 on both sides of the I-steel by connecting the upper limiting part 111 with the lower limiting part 112.

S1.2: installing the movable supporting component 2 formed by combining the top plate 22 and the four internal force transmission parts 21 on the fixed component 1, i.e. and inserting the four internal force transmission parts 21 into the four corresponding hollow casing pipes 12; and at this moment, the top plate 22 is made into contact with the upper limiting part 11;

S2: placing an assembling unit composed of the I-steel and the connecting assemblies behind the rock of a tunnel, adjusting the position of the I-steel to the top of the connecting assemblies to withstand the rock, and pouring the assembling unit to be connected and fixed with the rock of the tunnel, wherein a portion of the bottom of the connecting assemblies is reserved in the air during pouring;

Specifically, placing the assembling unit composed of the I-steel, the movable supporting component 2 and the fixed component 1 behind the rock of the tunnel, adjusting the position of the I-steel to make the top plate 22 to withstand the rock, and pouring the assembling unit by concrete to be connected and fixed with the rock of the tunnel, wherein a portion of one end of the casing pipe 12, the internal force transmission part 21 and the driving component 3 is reserved in the air during pouring, and the portion is not poured to facilitate the adjustment of the supporting force through this portion;

S3: connecting a jack and a jack stand to the bottom of the connecting assemblies, wherein the jack provides a jacking force for the connecting assemblies;

Specifically, connecting the base 31 to the bottom of the casing pipes 12 exposed to the air, fixedly connecting the power unit 32 to the base 31, and connecting the bearing plate of the power unit 32 with the four corresponding internal force transmission parts 21.

S4: starting the jack to drive internal force transmission tubes of the connecting assemblies to move up and down in hollow casing pipes of the connecting assemblies, and adjusting the state of the connecting assemblies to adjust the magnitude of the supporting force on the tunnel;

Specifically, starting the power unit 32, and driving the four internal force transmission parts 21 to move up and down in the hollow casing pipes 12 under the action of the jacking force of the power unit 32, wherein when the power unit 32 applies pressure, the reaction force is transmitted to the hollow casing pipes 12 through the base 31 and then to the I-steel.

S5: limiting and fixing the adjusted connecting assemblies; Specifically, inserting the limiting pin of each limiting component 13 into the positioning hole 211 of the internal force transmission part 21 through the long slot hole 121 of the casing pipe 12, and adjusting the position of the limiting nut to fix the limiting pin and simultaneously fix the internal force transmission part 21, so as to prevent the internal force transmission part 21 and the casing pipe 12 from generating relative displacement to cause the adjusted supporting force not to be maintained when the driving component 3 is removed.

S6: removing the jack and the jack stand, grouting the internal force transmission tubes and the hollow casing pipes, filling the gap between the connecting assemblies and the upper surface of I-steel after adjusting the supporting force, and grouting and filling the internal force transmission tubes and the hollow casing pipes.

Specifically, removing the driving component 3, grouting the hollow internal force transmission parts 21 and the casing pipes 12, filling the gap between the top plate 22 and the upper surface of I-steel after adjusting the supporting force, and grouting and filling the internal force transmission parts 21 and the casing pipes 12 to enhance the strength thereof and fix the internal force transmission parts 21 and the casing pipes 12.

Each embodiment in the description is described in a progressive way. The difference of each embodiment from each other is the focus of explanation. The same and similar parts among all of the embodiments can be referred to each other. The content not described in detail in the embodiments of the present invention belongs to the prior art known to those skilled in the art.

The above description of the disclosed embodiments enables those skilled in the art to realize or use the present invention. Many modifications to these embodiments will be apparent to those skilled in the art. The general principle defined herein can be realized in other embodiments without departing from the spirit or scope of the present invention. Therefore, the present invention will not be limited to these embodiments shown herein, but will conform to the widest scope consistent with the principle and novel features disclosed herein.

What is claimed is:

1. A tunnel supporting force adjusting device, which is arranged on section steel (4) at intervals, comprising:

a fixed component (1), connected with the section steel (4);

a movable supporting component (2), connected with the fixed component (1) and used for connecting with a tunnel trunk (5), wherein the movable supporting component (2), the fixed component (1) and the section steel (4) are fixedly connected with the tunnel trunk (5);

a driving component (3), detachably connected with the fixed component (1) and the movable supporting component (2) respectively to adjust the supporting force of the movable supporting component (2) on the tunnel trunk (5), wherein the fixed component (1) comprises a limiting connecting piece (11), connected with the section steel (4); casing pipes (12), connected with the limiting connecting piece (11) and slidably connected with the movable supporting component (2); limiting components (13), respectively connected with the casing pipes (12) and the movable supporting component (2) to fix the adjusted movable supporting component (2).

2. The tunnel supporting force adjusting device according to claim 1, wherein the movable supporting component (2) comprises: internal force transmission parts (21), slidably connected with the casing pipes (12); a top plate (22), connected with the internal force transmission parts (21) and used for connecting with the tunnel trunk (5) and applying a supporting force on the tunnel trunk (5).

3. The tunnel supporting force adjusting device according to claim 2, wherein the limiting connecting piece (11) comprises: an upper limiting part (111), connected with the upper surface of the section steel (4) and connected with one end of each casing pipe (12); a lower limiting part (112), connected with the lower surface of the section steel (4) and connected with the casing pipes (12) to limit the casing pipes (12).

4. The tunnel supporting force adjusting device according to claim 3, wherein the driving component (3) comprises: a base (31), detachably connected with the other end of each casing pipe (12); a power unit (32), arranged on the base (31) and connected with the internal force transmission parts (21) to drive the internal force transmission parts (21) to move.

5. The tunnel supporting force adjusting device according to claim 4, wherein each internal force transmission part (21) has a hollow tubular structure, and a plurality of positioning holes (211) are arranged in each internal force transmission part (21) at intervals and used for mating with the limiting components (13).

6. The tunnel supporting force adjusting device according to claim 4, wherein the number of the casing pipes (12) is four, the casing pipes (12) are symmetrically arranged on both sides of the section steel (4), and the internal force transmission parts (21) are in one-to-one correspondence to the casing pipes (12).

7. The tunnel supporting force adjusting device according to any one of claims 4-6, wherein each casing pipe (12) is provided with a long slot hole (121), and the internal force transmission parts (21) are fixed by the limiting components (13) through the long slot holes (121).

8. A tunnel supporting force adjusting method, comprising the following specific steps:

step 1: arranging a plurality of connecting assemblies on the I-steel at equal intervals;

step 2: placing an assembling unit composed of an I-shaped steel and the connecting assemblies behind the rock of a tunnel, adjusting the position of the I-shaped steel to the top of the connecting assemblies to withstand a rock, and connecting the assembling unit with the rock of the tunnel, wherein a portion of the bottom of the connecting assemblies is reserved in the air;

step 3: connecting a jack and a jack stand to the bottom of the connecting assemblies, wherein the jack provides a jacking force for the connecting assemblies;

step 4: starting the jack to drive internal force transmission tubes of the connecting assemblies to move up and down in hollow casing pipes of the connecting assemblies, and adjusting the state of the connecting assemblies to adjust the magnitude of the supporting force on the tunnel;

step 5: limiting and fixing the adjusted connecting assemblies;

step 6: removing the jack and the jack stand, grouting the internal force transmission tubes and the hollow casing pipes, filling the gap between the connecting assemblies and the upper surface of I-shaped steel after adjusting the supporting force, and grouting and filling the internal force transmission tubes and the hollow casing pipes.

* * * * *